US008104802B2

(12) United States Patent
Hollebone

(10) Patent No.: US 8,104,802 B2
(45) Date of Patent: Jan. 31, 2012

(54) INTEGRATED RECESSED LATCH ASSEMBLY

(75) Inventor: Kenneth Hugh Hollebone, Ontario (CA)

(73) Assignee: T.C.H. Sales, Inc., Toronto (CA)

( * ) Notice: Subject to any disclaimer, the term of this patent is extended or adjusted under 35 U.S.C. 154(b) by 371 days.

(21) Appl. No.: 12/290,597

(22) Filed: Oct. 31, 2008

(65) Prior Publication Data

US 2009/0127871 A1 May 21, 2009

Related U.S. Application Data

(60) Provisional application No. 61/003,264, filed on Nov. 15, 2007.

(51) Int. Cl.
*E05C 19/00* (2006.01)

(52) U.S. Cl. ..... 292/194; 292/336.3; 292/DIG. 53; 292/113

(58) Field of Classification Search ..... 292/194, 292/DIG. 27, DIG. 31, 336.3, DIG. 53
See application file for complete search history.

(56) References Cited

U.S. PATENT DOCUMENTS

| | | | | |
|---|---|---|---|---|
| 4,522,436 | A | 6/1985 | Hoen et al. | |
| 5,511,834 | A * | 4/1996 | Willems | 292/203 |
| D420,564 | S | 2/2000 | Willems | |
| D513,959 | S | 1/2006 | Willems | |

* cited by examiner

*Primary Examiner* — Kristina Fulton
(74) *Attorney, Agent, or Firm* — Simpson & Simpson, PLLC

(57) ABSTRACT

An integrated latch dish device including a latch with a translatable bolt for engaging a strike and a two part recessed dish having a lower first part and an upper second part adjacent to the lower first part, the lower first and upper second parts of the recessed dish each having front and back sides and cavities on each of the front sides, the latch pivotally mounted in the cavity of the lower first part of the recessed dish, the upper second part of the recessed dish comprising the strike integral with the dish and adjacent to the cavity, the integrated latch dish device further including means for affixing the latch to the dish through the back side of the lower first part of the recessed dish to shield the means for affixing the latch from environmental elements while providing tension on the strike by exerting a force through the bolt in a direction opposite from the strike.

10 Claims, 8 Drawing Sheets

INTEGRATED RECESSED LATCH ASSEMBLY

CROSS-REFERENCE TO RELATED APPLICATIONS

This patent application claims the benefit under 35 U.S.C. §119(e) of U.S. Provisional Patent Application No. 61/003,264, filed Nov. 15, 2007, which application is incorporated herein by reference.

FIELD OF THE INVENTION

The present invention relates generally to latch devices, and more particularly, to latches having engageable bolt and strike members mounted into a novel recessed dish, the latter of which performs both as a self-contained bracket for mounting and protecting the latch from impact and corrosion damage, while reducing the number of hardware components over earlier devices employing assembly dishes.

BACKGROUND OF THE INVENTION

Generally, a latch is a device used for securing first and second members together, e.g., a container lid and a container body. A container comprising a body as an enclosure and lid can be as basic as a reusable shipping container, capable of securely storing and transporting goods. Latches find numerous uses inter-alia, both in storage and transport containers to maintain a protective/secure environment. Thus, latches provide a convenient means for securing and ease of access in loading, storing and unloading enclosed contents.

However, latches mounted directly onto exterior surfaces of enclosures are often exposed to potential impact with other containers, especially during transportation. Latches that protrude from surfaces of containers or cases are especially vulnerable to a collision and damage from an obstruction, for example. To lessen such risk, recessed dishes have been used for mounting latches below the exterior surface of enclosures, for minimizing exposure and risk of damage to the latch.

One example of a recessed mounted latch is disclosed in U.S. Pat. No. 5,511,834 to Willems. The twist type latch of Willems is mounted onto a two-piece "dish" like structure. Twist type latches, such as that of Willems include a generally reliable rotation and draw mechanism that makes them highly versatile devices for many retention applications. The dishes for mounting the latches of Willems are divided into two parts where the twist latch, for example, is located in the lower first part of the two-part dish, and a hook device commonly called a keeper, is mounted on the second, upper portion of the two-part dish.

Thus, while the dish of Willems provides means for mounting a twist latch in a submerged space below the surrounding surface to help protect the latch from physical damage, the twist latch-dish combination of Willems is not entirely satisfactory. This inventor recognized that mounting the latch to a dish necessitates extra hardware components, including an anchor or bracket plate adapted for affixing the latch to the floor of the dish with mechanical fasteners, e.g., rivets or screws. The device of Willems also requires a separate keeper and mechanical fasteners for affixing to the upper part of the dish, collectively increasing assembly time and costs.

The methods of Willems also fail to integrate the latch into the dish sufficiently, so as to limit exposure of the hardware components to the elements, like rain and snow. For example, the coil springs of the twist latch are integral components of the device and provide the needed tension on the keeper by exerting a force in a direction opposite from the keeper. Consequently, the coil springs of the latch rely on constant flexural properties of the spring for optimum performance of the latch. However, exposure to environmental factors, such as water, ice, snow, heat, dirt, and the like, can result in corrosion of the springs and deterioration of spring performance, weakening, at least in-part, their ability to flex, reliably. Under such circumstances, the useful life expectancy of unprotected twist latches can become shortened.

Accordingly, there is a need for an improved, more economic dish-mounted latch device requiring fewer hardware components and abbreviated assembly time requirements, while possessing extended life expectancy from less exposure and better sheltering of key hardware components of the latch from potentially adverse environmental factors.

BRIEF SUMMARY OF THE INVENTION

It is therefore a principal object of the present invention to provide improved, integrated dish-mounted latch assemblies having fewer hardware components with shortened assembly time requirements, and therefore, latch assemblies having more attractive economics over prior recessed latch-dish mounted assemblies.

It is yet a further object of the invention to provide novel more thoroughly integrated latch-dish assemblies wherein key hardware components are sheltered from direct contact with environmental elements, such as rain, ice and snow, to extend the useful life expectancy of the latch, while providing a higher degree of safety to users by reducing the potential risk of injury to the hands.

More specifically, the present invention provides for a latch mechanism with fewer hardware components, and more particularly, the elimination of hardware components previously required for mounting and affixing the recessed latch and keeper or strike plate to the dish.

It is still a further principal object of the invention to provide an improved integrated latch dish device wherein the dish cooperates in the performance of the latch. That is, the dish provides the functional equivalent of the keeper or strike plate by providing a flange integral with the upper part of the two part dish in a cavity aligned with the cavity in the first part of the two part dish. The flange is positioned so that when the bolt of the arm assembly is fully extended it engages with the keeper/flange. Accordingly, the dish serves as a functional component in the operation of the latch by providing the keeper for the latch, further eliminating the customary keeper hardware for separately mounting to the dish.

The recessed dish is constructed in such a way that a central cavity or recess is positioned in the bottom wall or floor of the first or lower part of the two part dish, wherein the cavity or recess is adapted dimensionally for receiving the latch which also eliminates the need for the traditional twist latch anchor plate or mounting bracket hardware that previously functioned as the means for joining the latch to the dish. More specifically, the present invention integrates the latch mechanism and the dish through a pivot axis on the bolt arm of the latch by means of an axle running through the bolt arm and the sidewalls forming the cavity or recess, linking the latch to the dish while also enabling the latch to pivot arcuately relative to the dish.

The axle connecting the latch to the dish can be a fastener, such as a rivet, but more preferably, a linear portion of the coil spring. Thus, according to the present invention, as a preferred embodiment, the spring remains positioned on the backside of the dish wherein the floor wall of the dish shelters the spring from corrosion due to exposure to environmental elements, such as rain, snow and ice.

As previously indicated, in the integrated latch-dish device of the present invention there is a cavity or recess in the floor of the dish for mounting the latch. The cavity is fabricated with spaced, vertical, sidewalls in the floor of the two-part dish which performs as a mounting cavity or recess for the bolt arm body of the latch. The vertical sidewalls of the cavity are adapted so they are in juxtaposition and in close proximity to both edges of the bolt arm body. These walls also provide inter-alia support for the axle component of the latch sheltering the coil spring of the device from exposure to the elements.

Similarly, by integrating the keeper as a structural feature of the upper part of the dish, a separate keeper and mechanical fasteners therefor are also eliminated.

Thus, the present invention comprises an integrated latch dish device. The latch comprises a translatable bolt for engaging a strike and a two part recessed dish having a lower first part and an upper second part adjacent to the lower first part. The lower first and upper second parts of the recessed dish each have front and back sides and a cavity on each of the front sides. The latch is pivotally mounted in the cavity of the lower first part of the recessed dish. The upper second part of the recessed dish comprises a strike integral with the dish and adjacent to the cavity. The integrated latch dish device further comprises means for affixing the latch to the dish through the back side of the lower first part of the recessed dish to shield the means from environmental elements while providing tension on the strike by exerting a force through the bolt in a direction opposite from the strike.

The invention also comprises a dish for mounting a latch thereto. The dish comprises a peripheral sidewall, a recessed bottom wall or base forming a dish interior and a flange surrounding the peripheral sidewall adapted for mounting the dish to a container. The dish further comprises a cavity in the recessed bottom wall sized for receiving a latch. The dish is divided into two parts, a lower first part and an upper second part, wherein the upper second part further comprises a strike integral with the second part, and wherein the strike is in proximity to the cavity.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
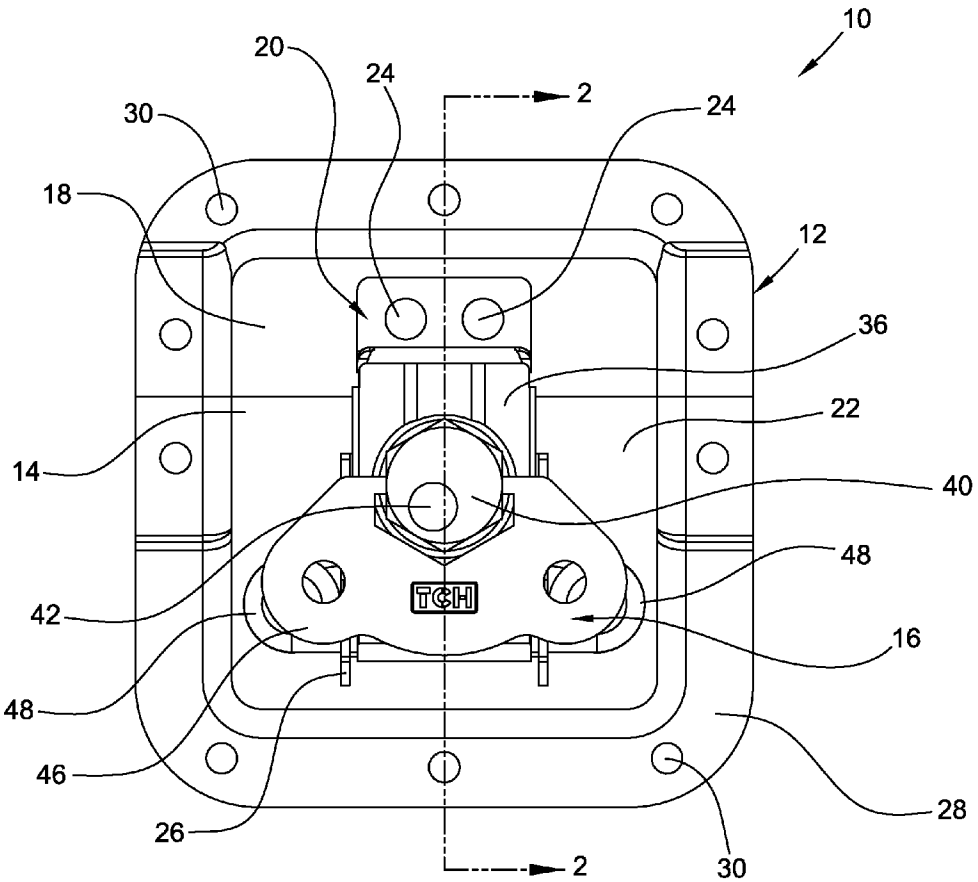
Prior Art Fig. 1
FIG. 1 is a front view of a prior art recessed dish with a latch and keeper.
Figure 3:
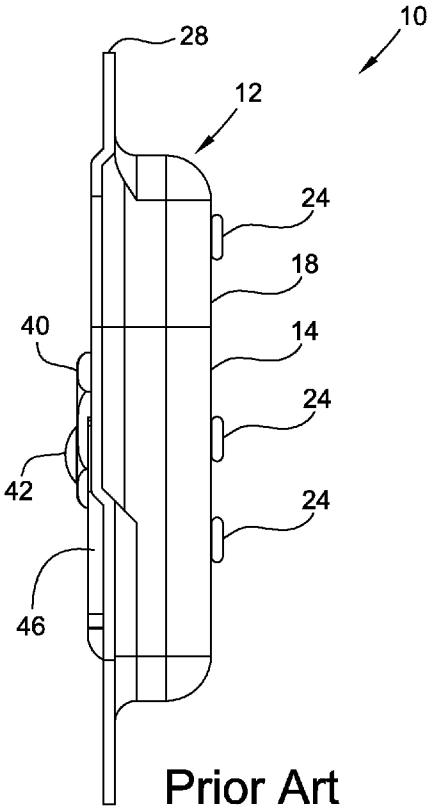
FIG. 3 is a side elevational view of the prior art recessed dish shown in FIG. 1.
Figure 2:
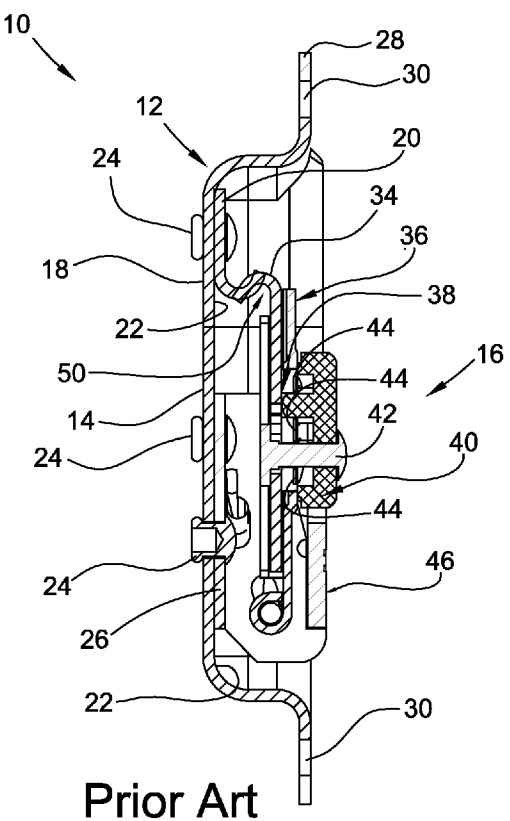
FIG. 2 is a cross sectional view of the prior art recessed dish shown in FIG. 1 taken generally along line 2-2 of FIG. 1.

A known recessed dish and latch assembly 10 is shown in FIGS. 1, 2 and 3, wherein recessed dish 12 comprises two parts, lower dish portion 14 having latch device 16 mounted thereto and upper dish portion 18 having keeper 20 mounted thereto. Both latch device 16 and keeper 20 are affixed to base or floor 22 of recessed dish 12 by means of fasteners 24. Latch device 16 is affixed to floor 22 through anchor plate or bracket 26 (See FIG. 2). Base or floor 22 of two part recessed dish 12 is flat for mounting the latch assembly thereto. Recessed dish 12 also comprises upper flange 28 surrounding the top edge of the dish with a plurality of apertures 30 for affixing to the edge of the surface of the container and lid (not shown).

Recessed dish 12 is separated into two parts, lower and upper dish portions 14 and 18, respectively, for affixing latch device 16 and keeper 20 thereto, respectively. The dish comprising latch device 16 is typically mounted into the body of a reusable shipping container (not shown). Keeper 20 of upper recessed dish portion 18 is mounted opposite lower recessed dish portion 14 in the lid of a shipping container.

Figure 4:
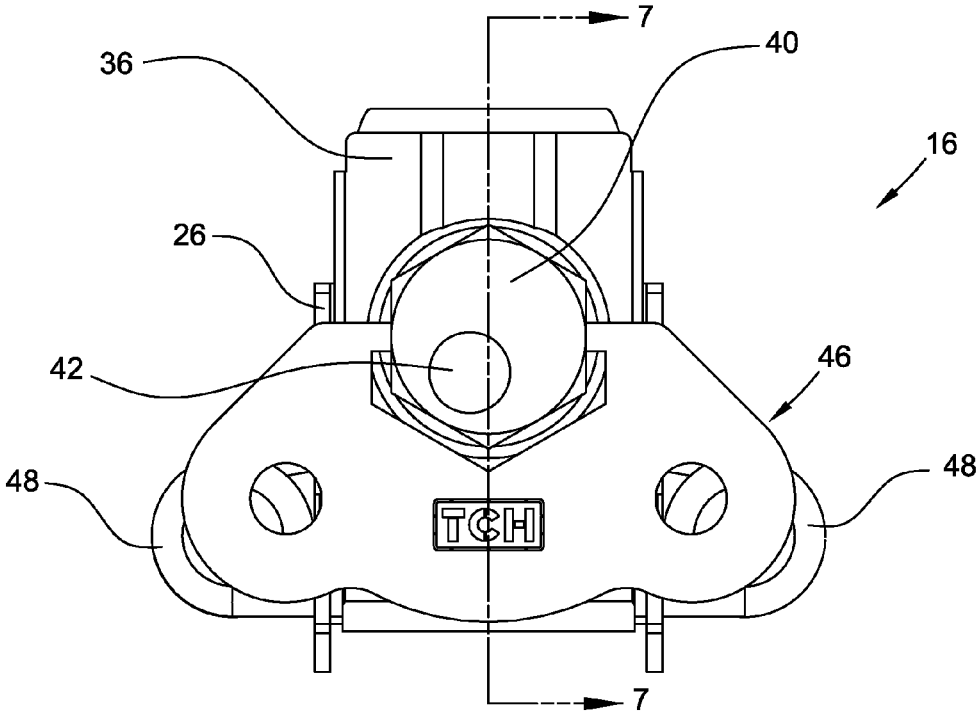
Prior Art Fig. 4
FIG. 4 is a front view of the prior art latch shown in FIG. 1 without the dish.
Figure 5:
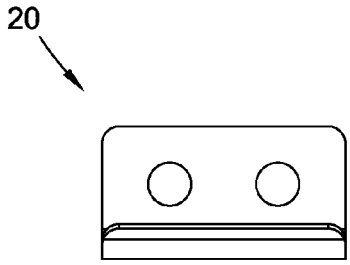
Prior Art Fig. 5
FIG. 5 is a front view of the prior art keeper shown in FIG. 1 without the dish and the latch.
Figure 6:
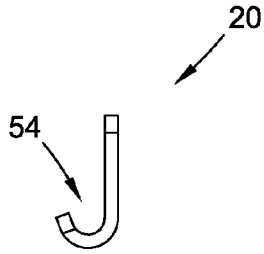
Prior Art Fig. 6
FIG. 6 is a side view of the prior art keeper shown in FIG. 5.
Figure 8:
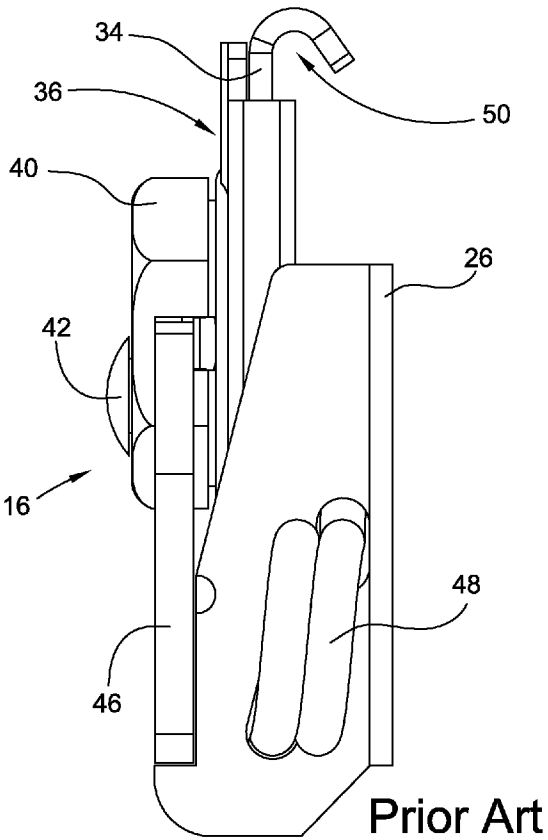
FIG. 8 is a side elevational view of the prior art latch assembly shown in FIG. 4.
Figure 7:
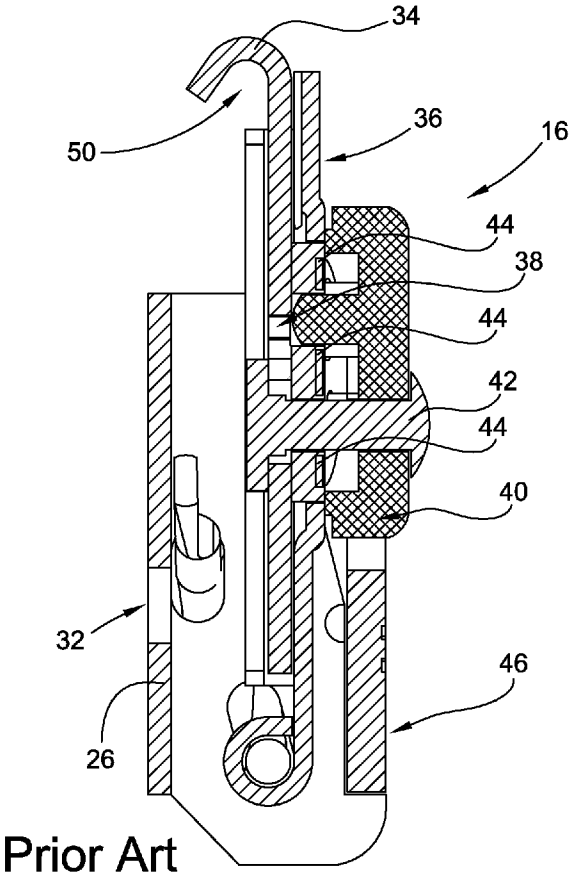
FIG. 7 is cross sectional view of the prior art latch assembly shown in FIG. 4 taken generally along line 7-7 of FIG. 4.

Details of a known latch assembly alone are illustrated in FIGS. 4, 7 and 8, while details of a known keeper alone are shown in FIGS. 5 and 6.

The known latch device 16 consists of anchor plate or mounting bracket 26 for affixing the latch to the base of a dish by means of fasteners 24 applied through apertures 32 in bracket 26. Other features of the known latch include bolt 34 in bolt arm body 36, lower cam 38, cylinder 40, cam rivet 42, cam spring 44, key 46, and spring 48 having dual coils. As is known in the art, cam spring 44 applies pressure against key 46 to hold key 46 in various positions.

Bolt 34 includes hook-shaped component 50 at the terminal end of the bolt for engaging with known keeper or striker plate 20 shown in FIGS. 5 and 6 with hook feature 54. Typically, by rotating key 46 bolt 34 slidably extends from one end of bolt arm body 36 to engage the striker plate 20. Thus, the extension and retraction of bolt 34, i.e., locking and unlocking the container, is controlled by rotation of key 46 which is pivotally carried by cylinder 40.

Figure 10:
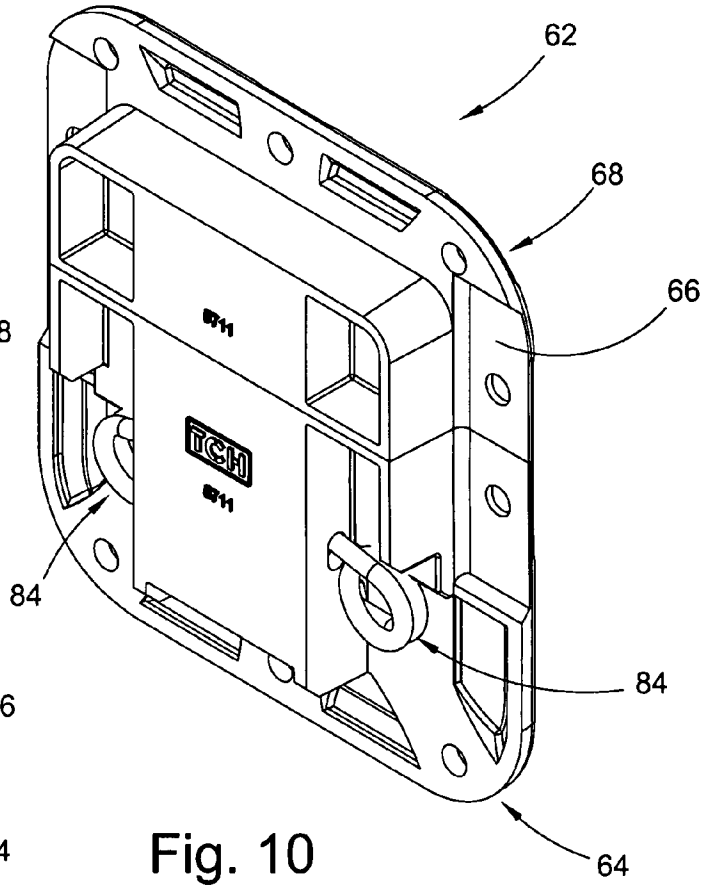
FIG. 10 is a back perspective view of an embodiment of a present invention integrated latch dish assembly.
Figure 9:
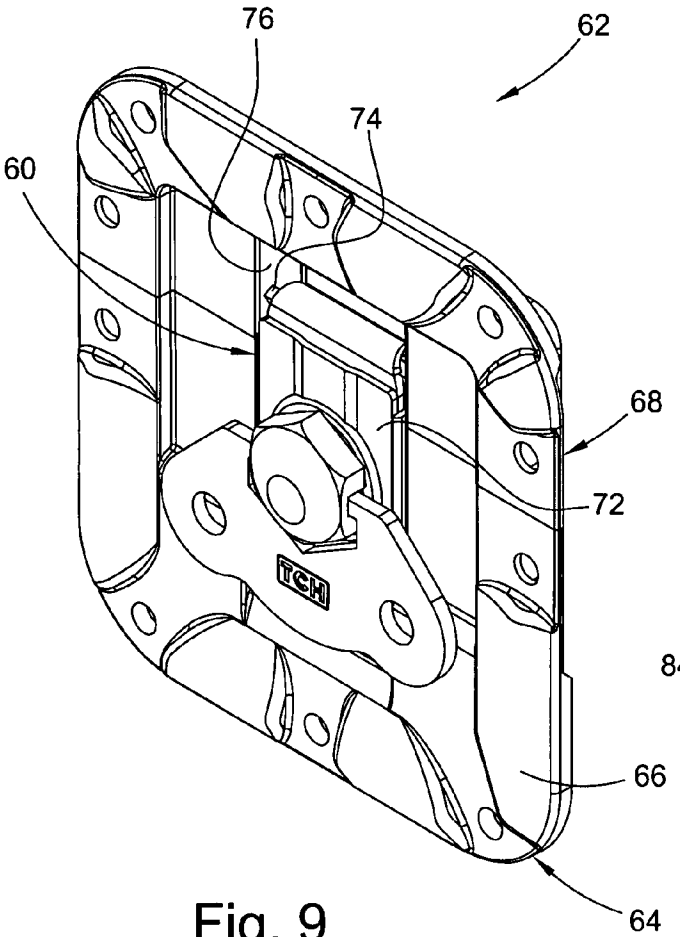
FIG. 9 is a front perspective view of an embodiment of a present invention integrated latch dish assembly.
Figure 12:
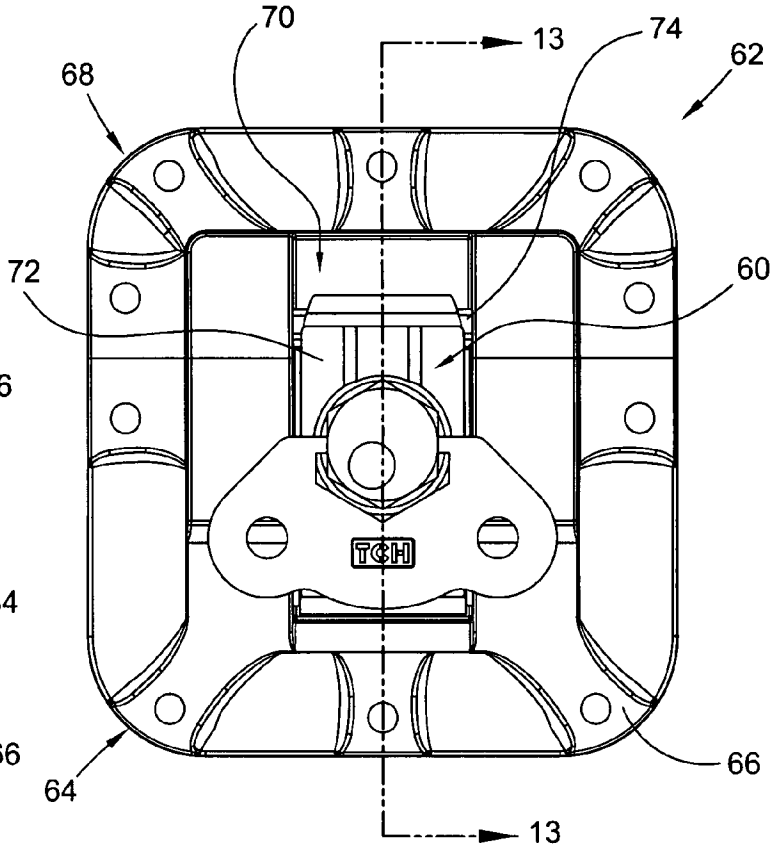
FIG. 12 is a front elevational view of an embodiment of a present invention integrated latch dish assembly.
Figure 11:
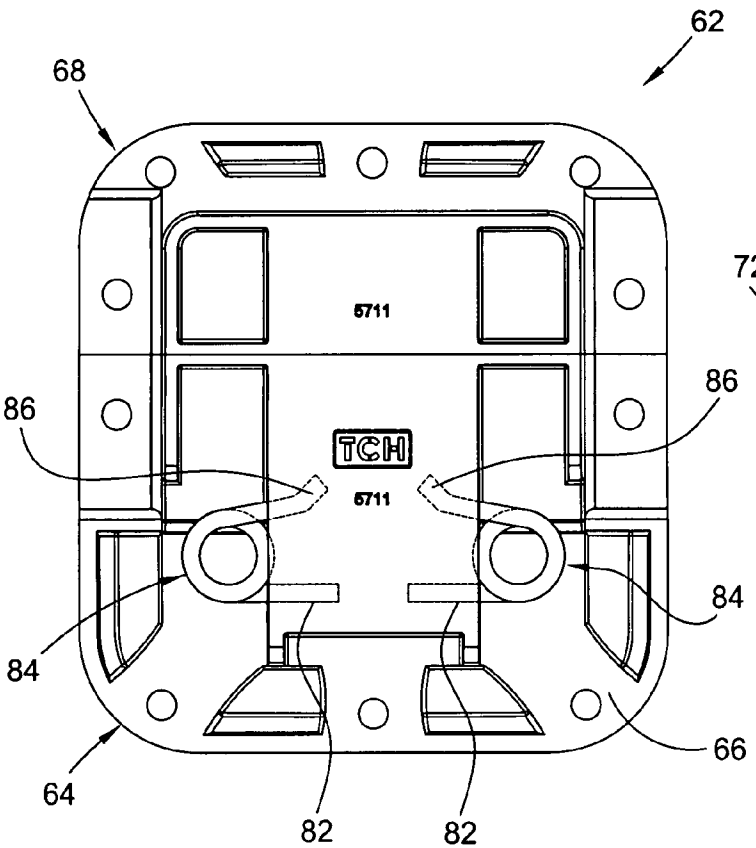
FIG. 11 is a back elevational view of an embodiment of a present invention integrated latch dish assembly showing dual coil springs.
Figure 14:
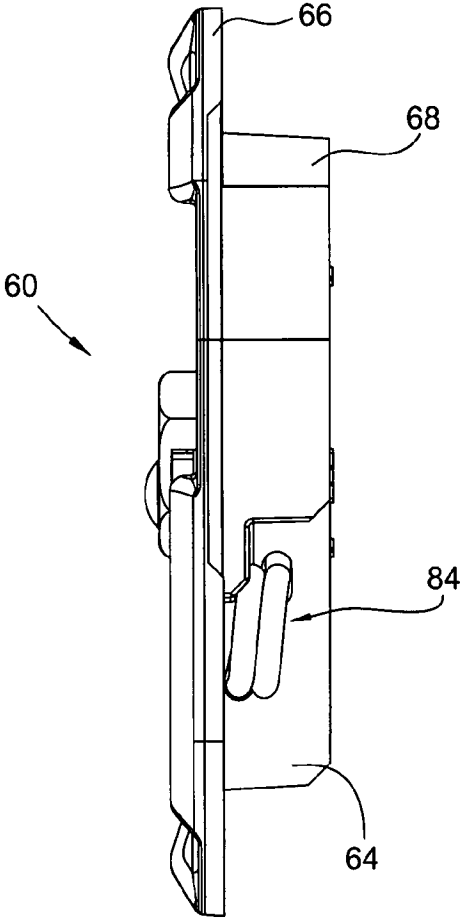
FIG. 14 is a side elevational view of an embodiment of a present invention integrated latch dish assembly.
Figure 13:
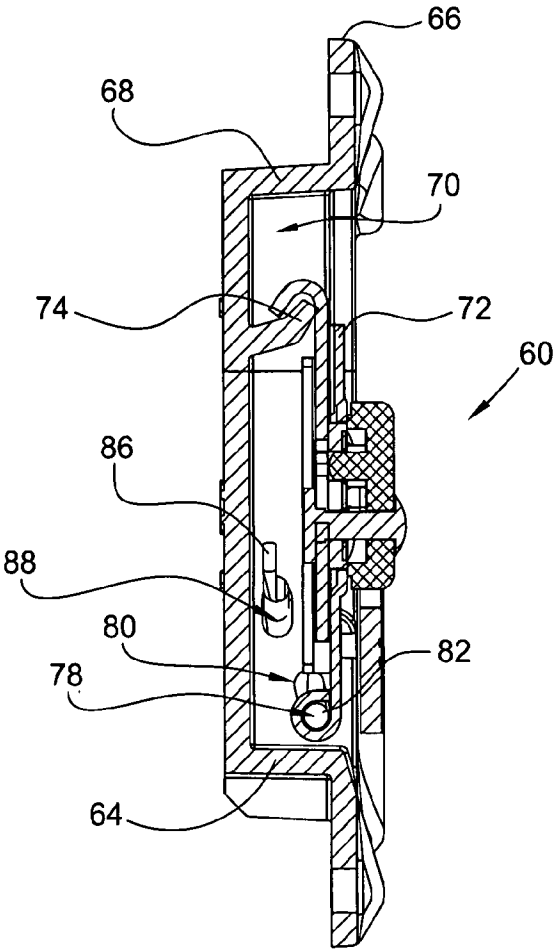
FIG. 13 is a cross sectional view of an embodiment of a present invention integrated latch dish assembly taken generally along line 13-13 of FIG. 12.
Figure 16:
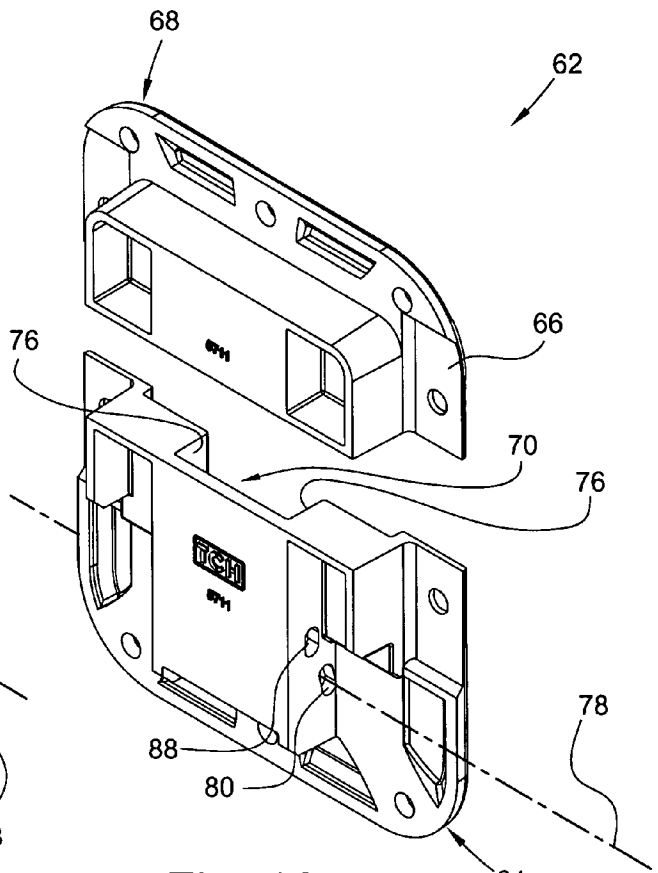
Figure 15:
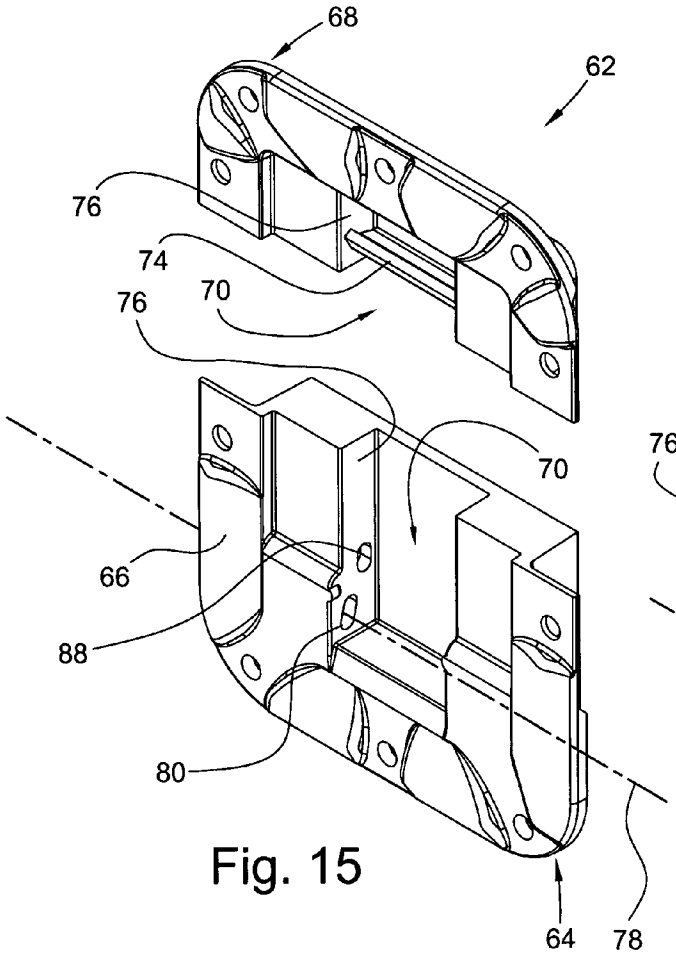
FIG. 15 is a front perspective view of an embodiment of a present invention integrated latch dish; and, FIG. 16 is a back perspective view of an embodiment of a present invention integrated latch dish.

A preferred embodiment of a present invention integrated latch and dish is shown in the front perspective view in FIG. 9, the back perspective view in FIG. 10, the back elevational view of FIG. 11, the front elevational view in FIG. 12, the cross sectional view in FIG. 13, the side elevational view in FIG. 14 and the front and back perspective views in FIGS. 15 and 16, respectively. The following is best understood in view of FIGS. 9 through 16.

Integrated latch 60 and two part dish assembly 62 of the present invention, best illustrated by FIGS. 9-16, provide for additional improvements over known latch-dish assemblies previously discussed. Latch 60, when mounted to the lowest portion of base 64 of the dish, is approximately even with the upper edge or flange 66 of the dish to optimize protection of the latch from impact damage. The dish comprises two parts, lower latch portion 64 and upper keeper or strike portion 68. The central part of lower latch portion 64 includes latch cavity or depression 70 with sidewalls dimensioned to substantially coincide with the length and width of bolt body 72. Keeper or strike 74 (See FIGS. 13 and 15) of strike portion 68 of the upper dish includes a continuation of the latch cavity 70 from latch portion 64 of the dish, which runs to the upper recessed end wall of keeper or strike portion 68 of the two part dish.

As previously indicated, heretofore the keeper was customarily mounted as a separate hardware component to the keeper portion of the recessed dish. However, in the present invention keeper or strike 74 is fabricated as a bar in the cavity of strike portion 68 of the dish during the process of molding the dish, so keeper or strike 74 is integral with that section of the dish. Accordingly, keeper 74 of the present invention is incorporated into the dish and is an integral feature of the upper portion of the dish. More specifically, strike/keeper 74 is integrated into and supported by both the floor portion of the cavity and sidewalls 76 of latch cavity 70. It should be appreciated that although keeper 74 is shown to be molded or formed from the same material as strike portion 68, e.g., plastic or metal, it is also within the spirit and scope of the claimed invention to mold a metal keeper with a plastic strike portion or a plastic keeper within a metal strike portion.

The dish is preferably fabricated by injection molding thermoplastic resins, including but not limited to ABS plastics; Nylon reinforced with glass fiber; polyolefins, such as high density polyethylene; polypropylene; and, including other thermoplastics, such as polystyrene, and so on. It will also be understood that materials other than plastics may be used in fabricating the dishes of the invention, e.g., metals, such as aluminum and steel.

Latch assembly 60 of the present invention omits lower mounting bracket 26 of the known latch (See FIGS. 4, 7 and 8), but instead is pivotally mounted inside cavity 70 from the lower end of the latch through pivot axis 78. Latch 60 is mounted within cavity 70 through pivot slot 80 (See FIG. 13), so that the latch is able to move through an arc of approximately 90°.

Sidewalls 76 of cavity 70 provide lateral support to latch mechanism 60 which is affixed and supported in the cavity through pivot axis 78 by means of a hinge. The latch mechanism is secured in the cavity by dual axles 82 which engage with pivot slot 80. Axle 82 may be a rod or straight length of steel extending through sidewalls 76 of latch cavity 70, or by separate, independent coil springs 84 (See FIGS. 10 and 11). Hinge-axle 82 or pivoting fasteners are assembled from the exterior sides of the latch portion of recessed dish 64 through pivot axle slot 80 into the latch cavity.

The latch assembly is assembled into the dish with simple tools depending on the mechanical fastener used. The latch mechanism is inserted into latch cavity 70, aligning both dish component 64 and the latch body along axial pivot 78. Coil springs 84 are compressed torsionally by rotating the linear sections at each end of the spring towards each other. With the coil spring in a compressed state, the spring is inserted from the backside through the walls of cavity 70 of the dish into the latch mechanism at axial pivot 78. Terminal ends 86 of the coil springs 84 pass through slots 88 in the cavity side walls 76 holding the coil springs in a fixed taut position.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. An integrated latch dish device comprising:

a latch with a translatable bolt for engaging a strike;

a two part recessed dish having a lower first part and an upper second part adjacent to said lower first part, said lower first and upper second parts of said recessed dish each having a front side defining a floor and a back side opposing said floor, and a cavity on said front side, said latch pivotally mounted about an axis in said cavity of said lower first part of said recessed dish, said lower first part of said recessed dish comprising oppositely disposed first and second apertures in aligned registration with said axis, said upper second part of said recessed dish comprising said strike integral with said dish and adjacent to said cavity; and, means for affixing said latch to said dish through said back side of said lower first part of said recessed dish shielding said means for affixing said latch from environmental elements while providing tension on said strike by exerting a force through said bolt in a direction opposite from said strike, wherein a portion of said means for affixing said latch passes through said oppositely disposed first and second apertures and is in aligned registration with said axis.

2. The integrated latch dish device of claim 1 wherein said means for affixing comprises at least one spring.

3. The integrated latch dish device of claim 1 wherein said means for affixing comprises at least one rod.

4. The integrated latch dish device of claim 1 wherein said means for affixing comprises at least one rivet.

5. The integrated latch dish device of claim 1 wherein said latch is arranged to pivot approximately 90° relative to said two part recessed dish.

6. The integrated latch dish device of claim 1 wherein said two part recessed dish is constructed by injection molding a thermoplastic resin.

7. The integrated latch dish device of claim 6 wherein said thermoplastic resin is selected from the group consisting of: an ABS, a nylon reinforced with glass fiber, a polyolefin, a high density polyethylene, a polypropylene and a polystyrene.

8. The integrated latch dish device of claim 1 wherein said two part recessed dish is constructed from a metal.

9. The integrated latch dish device of claim 8 wherein said metal is selected from the group consisting of: an aluminum and a steel.

10. The integrated latch dish device of claim 1 wherein said two part recessed dish further comprises a flange and said latch is arranged approximately even with said flange.

* * * * *